United States Patent [19]

Ferrozzi

[11] 4,000,599

[45] Jan. 4, 1977

[54] FOLDER

[75] Inventor: Claudio Ferrozzi, Ferrara, Italy

[73] Assignee: AMF Incorporated, White Plains, N.Y.

[22] Filed: Mar. 1, 1976

[21] Appl. No.: 662,295

[30] Foreign Application Priority Data

July 3, 1975 Italy ..... 12503/75

[52] U.S. Cl. ..... 53/378; 93/27; 93/49 R

[51] Int. Cl.[2] ..... B65B 7/04

[58] Field of Search ..... 53/374, 378; 93/12 R, 93/12 C, 22, 26, 27, 28, 36.8, 49 R

[56] References Cited

UNITED STATES PATENTS

| | | | |
|---|---|---|---|
| 2,849,846 | 9/1958 | McGihon | 53/374 |
| 3,124,046 | 3/1964 | Jungmayr | 93/12 R |

*Primary Examiner*—Travis S. McGehee
*Assistant Examiner*—John Sipos
*Attorney, Agent, or Firm*—George W. Price; Charles J. Worth

[57] ABSTRACT

The folding mechanism for folding a flap of the wrapper against a face of a cigarette pack moving at a uniform speed along a conveying path in a direction parallel to said face, comprises a pair of rotatable discs facing each other and spaced apart, which have their axes of rotation parallel to and excentrically arranged with respect to each other, said axes being further inclined of a predetermined oblique angle with respect to the conveying path of the cigarette pack. The two discs are connected in their rotation by three connecting rods linking respective crank pins provided excentrically on the said discs, so that rotation of one of the discs causes a concurrent rotation of the other disc. Onto one of the said connecting rods there is provided a projecting folder element which presents a flat surface parallel to and intended to engage the flap to be folded. Upon operation of the mechanism consequent to rotation of one of the discs in correct time relationship with the speed of the pack along the conveying path, the folder element engages the flap in a direction which is transverse to the direction of movement of the pack, while simultaneously accompanying the pack in its movement, and at the same time moving cyclically to-and-fro perpendicularly with respect to the face of the pack against which the flap is folded.

4 Claims, 3 Drawing Figures

FOLDER

SUMMARY OF THE INVENTION

The present invention relates to a folding mechanism, which is particularly adapted to fold the flap of a wrapper against a face of a body of right parallelepiped form which has been already partially enclosed by the wrapper as in a tube, at least on other four faces. More particularly, the invention relates to a folding mechanism used in cigarette packing machines, in which an orderly block of 20 cigarettes is wrapped in foil and paper, sometimes with an outer covering of cellophane or the like, so as to realize a soft pack, so called "american pack", in contrast with the other pack commonly used, which is the rigid or hard box pack.

The folding mechanism according to the invention serves for making one of the folds required to close either the top or the bottom of the pack. Preferably the fold is made in the area of one of the pack narrow sides. The mechanism performs the operation during the uniform movement of the pack along a conveying path in the cigarette packing machine.

Substantially, in the folding mechanism according to the invention, a folding tool or folder is guided in its motion along a closed path such as to interfere, operatively and in synchronism, with the path of the packs being conveyed and presenting a wrapper flap to be folded, the said folder being mounted on movable supporting means which perform such a movement that, during the operative engagement of the folder with the flap to be folded, said folder has a "dipping" motion component which is perpendicular to the direction of motion of the pack (said dipping component being the one which actually effects the folding), a motion component which is parallel to the direction of advancement of the pack along the conveying path, and a cyclical to-and-fro movement perpendicular to the side or face of the pack against which the flap is folded.

The folding mechanism according to the invention substantially comprises a pair of rotatable discs which face each other and are suitably spaced apart, said discs having their axes of rotation parallel to and eccentrically arranged with respect to each other, the axes of said discs being further inclined of a predetermined angle with respect to the conveying path of the cigarette packs. The two discs are connected in their rotation by at least one connecting rod (preferably three) which links a crank pin provided eccentrically on one of said discs to a respective crank pin provided on the other disc, in such a manner that the distance between the said crank pins linked by the connecting rod is equal to the distance between the axes of rotation of the two discs, whereby, as above mentioned, rotation of one of the discs causes a concurrent rotation of the other disc.

Onto one of the said connecting rods, there is provided the proper folder element, which in its simplest form is a projecting body presenting a flat surface which dips into and folds the flap of the pack. Upon operation of the mechanism consequent to rotation of one of the discs in correct time relationship with the speed of translation on the pack along the conveying path, the folder element engages the flap to be folded in a direction which is transverse to the direction of translation, while simultaneously accompanying the pack in its translatory movement, and at the same time moving cyclically to-and-fro perpendicularly with respect to the said face of the pack.

The folding mechanism according to the invention is therefore very compact in its construction, thus occupying a very limited space, and can be operated at very high speeds.

The above and other features of the invention, and the advantages deriving therefrom, will appear evident from the following detailed description of a preferred embodiment of same, made with reference to the attached drawings.

DESCRIPTION OF THE PREFERRED EMBODIMENT

Figure 1:
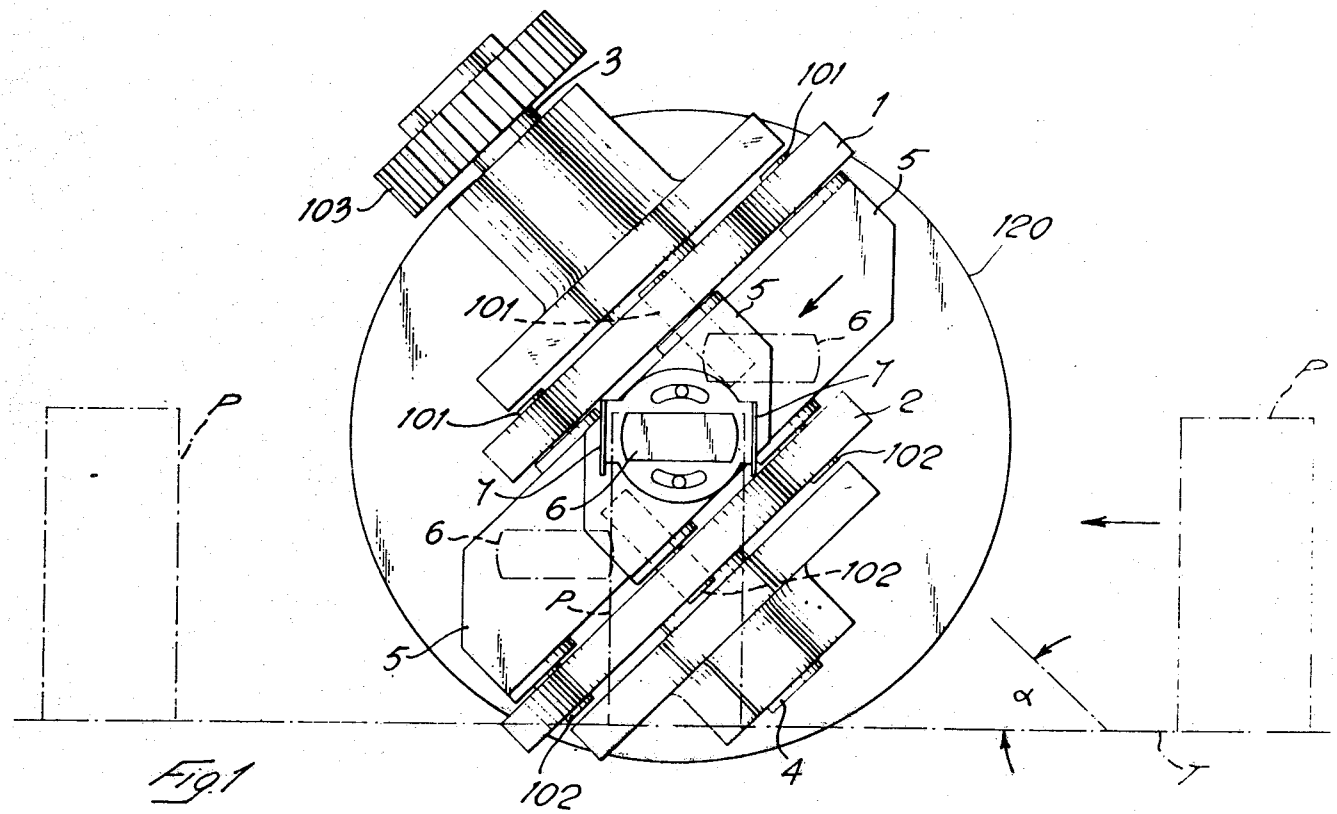
FIG. 1 is a front elevation of the folding mechanism according to the invention, applied to a cigarette packing machine, this view resulting perpendicular to the conveying path of the packs to be closed.

With reference to the drawings, the folding mechanism according to the invention consists of two equal discs 1 and 2 mounted respectively onto the facing ends of two shafts 3, respectively 4. The shafts 3, 4 are rotatably mounted on suitable bearings of a support member 120 so as to result parallel between each other and spaced in such a manner as to obtain a desired interspacing distance between the facing sides of discs 1 and 2.

On their facing sides, discs 1 and 2 carry three respective projecting crank pins 101, 102, which are parallel to shafts 3 and 4 and are angularly and radially equispaced around the axes of rotation of the respective discs 1, 2.

The pins of the two discs form an equal number of orderly arranged pairs 101, 102 which constitute the crank pins of respective equal connecting rods 5 which thus are interposed in an orderly manner between the discs. Therefore, in the illustrated embodiment, there are three connecting rods 5, movable along a closed path so as to always result parallel between one another, whenever for example disc 1 is rotated under the action of drive gear 103 keyed onto shaft 3, said drive gear 103 being on its turn driven in correct time relationship with the operation of the packing machine in general and particularly with the translatory movement of the packs of cigarettes presenting a flap to be folded.

The distance between the two crank pins connected by each connecting rod 5 is equal to the distance between the axes of rotation of discs 1 and 2, i.e. to the eccentricity of one disc with respect to the other. Rotation of disc 1 driven by gear 103 will promote automatically the concurrent rotation of disc 2, coupled to disc 1 through connecting rods 5.

One of the three connecting rods 5 carries a folder element 6, having a substantially parallelepiped shape.

Shafts 3 and 4 are inclined in relation to the direction T of the path of uniform rectilinear motion of pack P, of a certain oblique angle $\alpha$ (alpha). The folder element 6 is set in such a manner as to be oriented with its active surface parallel to the flap L to be folded. This means that the active surface of folder 6 forms the same angle $\alpha$ (alpha) with respect to the plane on which connecting rods 5 move.

As a result of the inclination of shafts 3 and 4, the folder 6 has a speed component which is perpendicular to the conveying path of the packs and which constitutes the so called folding component, and a speed component which is parallel to the conveying path of the packs and has the same advancing direction. This constitutes the so called advancing or accompanying component.

By suitably adjusting the inclination of parallel shafts 3 and 4 with respect to the conveying path T of the packs, it is obtained that the said accompanying component is equal to the speed of the translatory movement of the pack. In order to facilitate the neat and symmetric folding of the flap L, two side plates 7, or vertical guiding blades, are associated to folder 6.

Figure 2:
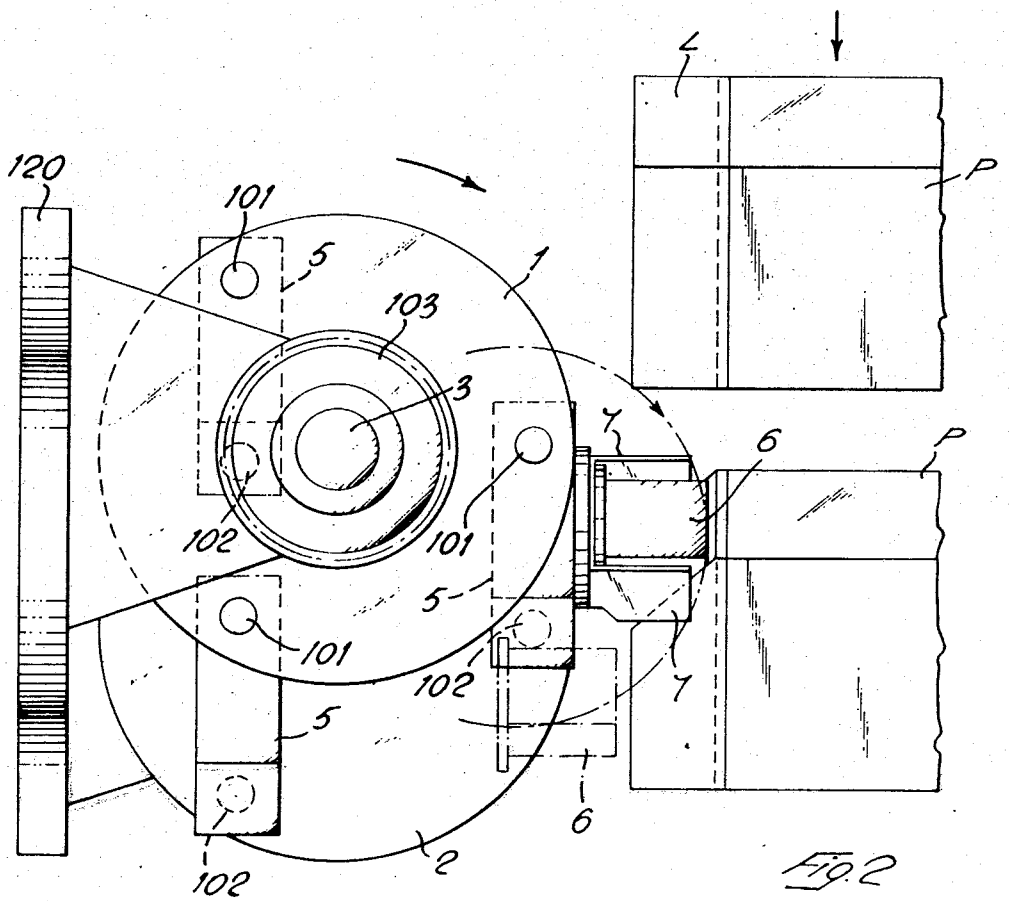
FIG. 2 is a view from above in the direction defined by the oblique angle $\alpha$ (alpha) of FIG. 1.
Figure 3:
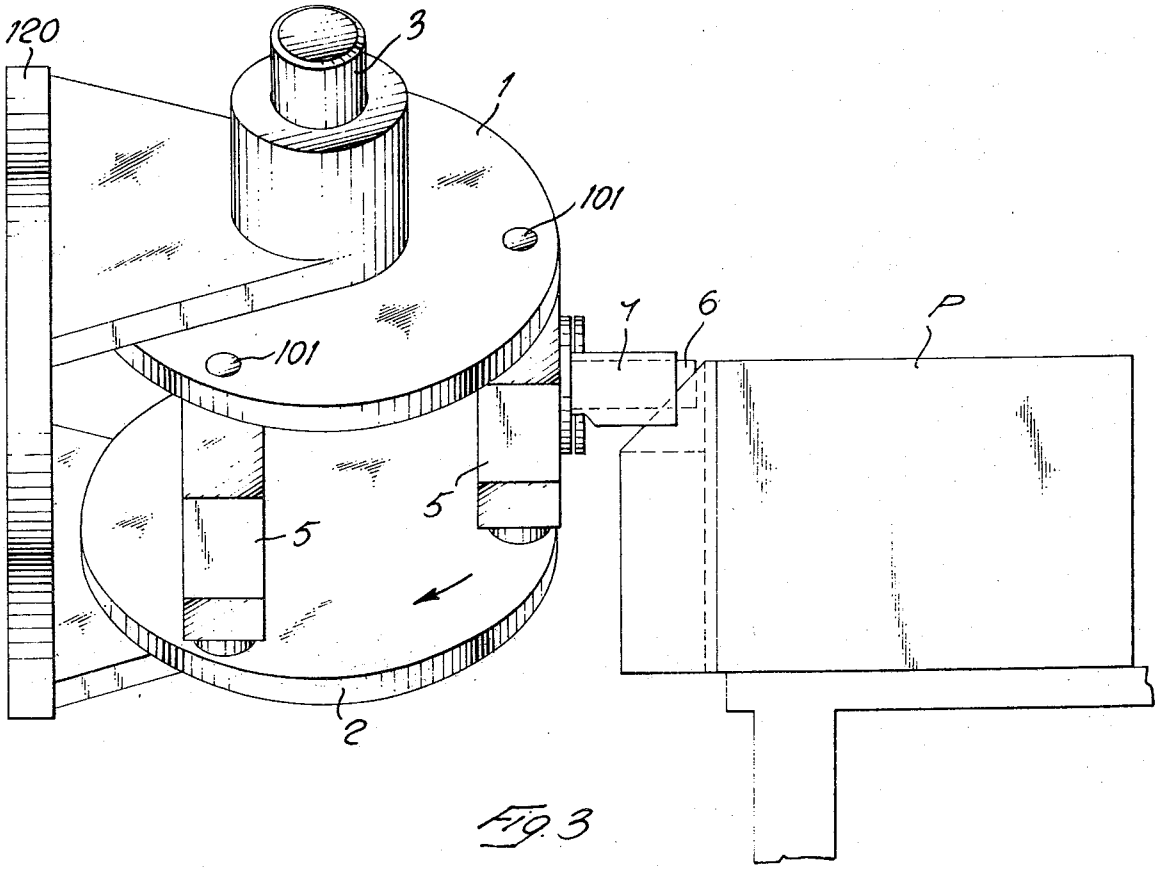
FIG. 3 is a side view of the folding mechanism according to the invention.

As it clearly appears from FIG. 2, the folder 6 moves also cyclically to-and-fro with a translatory movement which is perpendicular to the face of the pack onto which the flap L is to be folded.

Obviously, the above described folding mechanism can be adopted also when the conveying path of the packs is not rectilinear but, for instance, circular.

It is believed that the invention will have been clearly understood from the foregoing detailed description of one preferred embodiment. Changes in the details of construction may be resorted to without departing from the spirit of the invention, and it is accordingly intended that no limitation be implied and that the hereto annexed claims be given the broadest interpretation to which the employed language fairly admits.

I claim:

1. A folding mechanism for folding a flap of a wrapper against a face of a body of right parallelepiped form which has been already partially enclosed by the wrapper as in a tube on at least other four faces, while the partially wrapped body is translated at a uniform speed along a conveying path in a direction parallel to the said face, said folding mechanism comprising:

a. a pair of rotatable discs which face each other and are suitably spaced apart, said discs having their axes of rotation parallel to and eccentrically arranged with respect to each other, said axes of said discs being further inclined of a predetermined oblique angle with respect to the said conveying path;

b. at least one connecting rod for connecting a crank pin provided eccentrically on one of said discs with a respective crank pin provided eccentrically on the other facing disc, in such a manner that the distance between the said crank pins is equal to the distance between the axes of rotation of the two discs, whereby rotation of one of the discs causes a concurrent rotation of the other disc;

c. a folder element provided onto one of the said connecting rods, whereby upon operation of the mechanism consequent to rotation of one of the discs in correct time relationship with the speed of translation of the body along the conveying path, the folder element engages the flap to be folded in a direction which is transverse to the direction of translation, while simultaneously accompanying the body in its translatory movement, and at the same time moving cyclically to-and-fro perpendicularly with respect to the said face of the body.

2. A folding mechanism according to claim 1, in which the axes of rotation of the said discs are arranged on a plane which is parallel to the direction of translation of the body along the conveying path.

3. A folding mechanism according to claim 1, in which the folder element presents an active surface intended to engage the flap to be folded, said active surface being substantially flat and being arranged in such a position as to result parallel to the flap to be folded.

4. A folding mechanism according to claim 3, in which the folder element is constructed as a substantially right parallelepiped body arranged with suitable positioning onto one of the said connecting rods, so as to present two faces parallel to the flap to be folded and other two faces perpendicular to said flap, a side guiding plate or blade being provided in correspondence of each of the two perpendicular faces, spaced apart and parallel thereto, in order to facilitate the folding of the flap.

* * * * *